US005826361A

United States Patent [19]

Jamison

[11] Patent Number: 5,826,361

[45] Date of Patent: Oct. 27, 1998

[54] SHORT-ACTION CHAMBER AND BOLT ASSEMBLY FOR HIGH POWER FIREARM CARTRIDGE

[76] Inventor: John R. Jamison, 84784 Christensen Rd., Eugene, Oreg. 97405

[21] Appl. No.: 818,440

[22] Filed: Mar. 17, 1997

[51] Int. Cl.[6] ..... F41A 3/00

[52] U.S. Cl. ..... 42/25; 42/16

[58] Field of Search ..... 42/14, 16, 76.01, 42/25; 29/1.1

[56] References Cited

U.S. PATENT DOCUMENTS

| | | | |
|---|---|---|---|
| 2,464,323 | 3/1949 | Lee | 29/1.1 |
| 2,685,754 | 8/1954 | Crittendon et al. | 42/16 |
| 3,738,224 | 6/1973 | Post et al. | 42/25 |
| 3,846,928 | 11/1974 | Ruger et al. | 42/16 |
| 3,893,321 | 7/1975 | Braunwieser | 29/1.1 |
| 4,265,043 | 5/1981 | Rowlands | 42/25 |
| 4,272,902 | 6/1981 | Waters | 42/25 |
| 4,359,810 | 11/1982 | Osborne et al. | 29/1.1 |
| 4,457,092 | 7/1984 | Hupp et al. | 42/25 |
| 4,651,455 | 3/1987 | Geiser, Jr. | 42/16 |
| 5,463,959 | 11/1995 | Kramer . | |

OTHER PUBLICATIONS

Howe, James Virgil. "The Modern Gunsmith," vol. II, New York: pp. 119, 120, 123–125, 128, 129 and 172, Sep. 1937.

Barnes, Frank C. "Cartridges of the World," Chicago, p. 35, Apr. 1965.

"22PPC Cartridge," *Rifle Reloading Data*, p. 203 (1974) Month Unknown.

Jamison, "Precision Reloading," *Shooting Times*, Jan. 1996, pp. 28–35.

".30/.378 Arch," *Handbook for Shooters and Reloaders*, p. 442 (1986), (Month unknown).

*Primary Examiner*—Charles Jordan
*Assistant Examiner*—Theresa M. Wesson
*Attorney, Agent, or Firm*—Chernoff, Vilhauer, McClung & Stenzel

[57] ABSTRACT

A firearm cartridge case capable of withstanding internal gas pressures of at least about 50,000 psi has two substantially cylindrical portions of significantly different diameters interconnected by a frusto-conical shoulder portion. The case has a ratio of its overall length to its diameter, at a location 1.25 inch from its base, of no more than about 4.2, giving it an unusually short, fat profile. The base of the case has a rim with an outer diameter substantially no less than the case diameter at the aforementioned location, to facilitate reliable feeding of the cartridge from the magazine. The corresponding firearm chamber which matingly accepts the cartridge is capable of withstanding internal gas pressures of at least about 65,000 psi. A short-action bolt assembly smoothly and reliably feeds and chambers each cartridge by providing an extractor grippingly engageable with the cartridge by movement of the cartridge transversely to the bolt face when the bolt is in its unlocked position, so as to grip the cartridge while the bolt pushes the cartridge into the chamber.

2 Claims, 3 Drawing Sheets

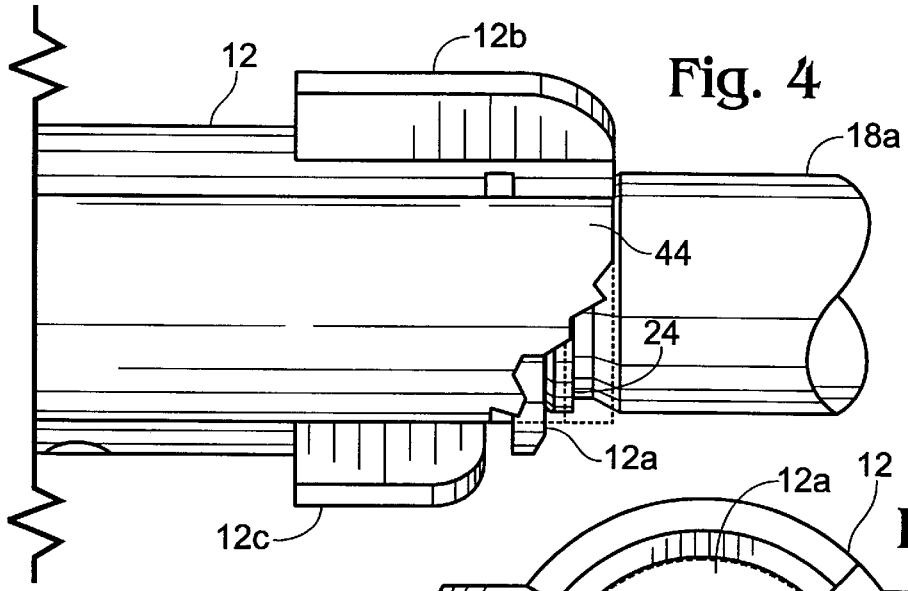
Fig. 4
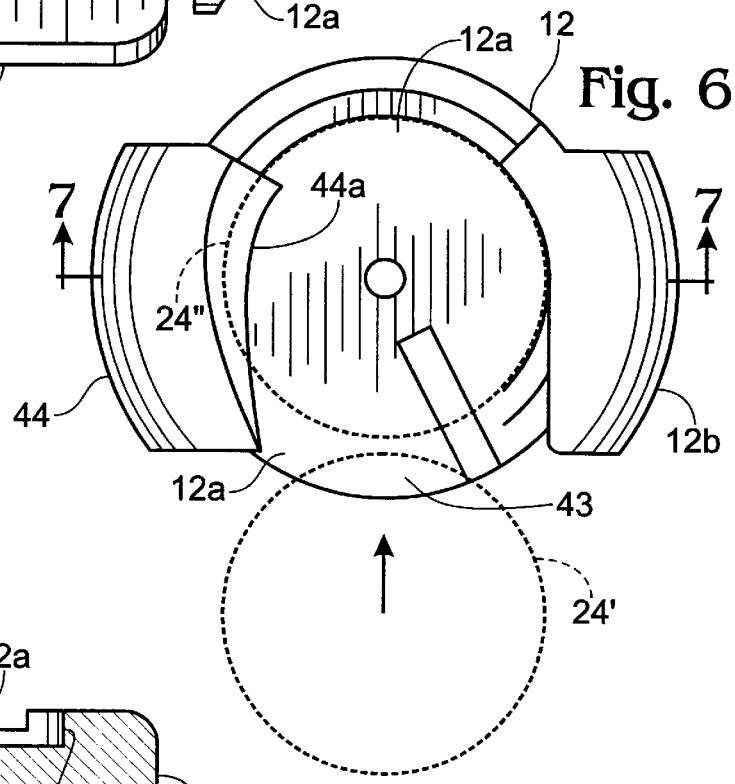
Fig. 6
Fig. 7
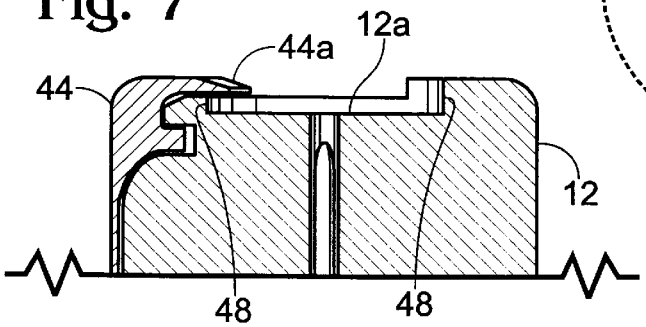
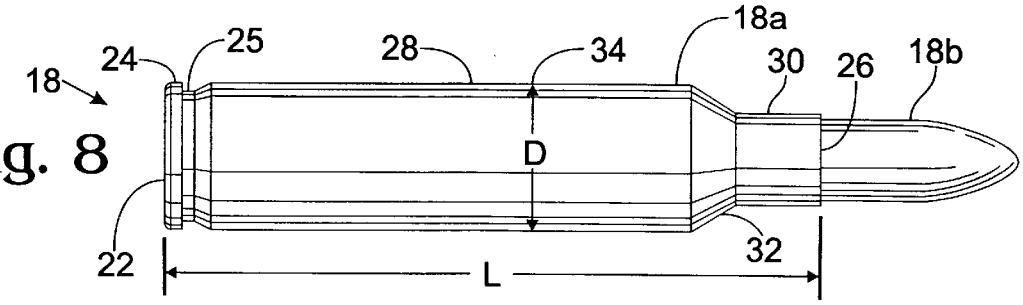
Fig. 8

SHORT-ACTION CHAMBER AND BOLT ASSEMBLY FOR HIGH POWER FIREARM CARTRIDGE

BACKGROUND OF THE INVENTION

The present invention is directed to a short-action chamber and bolt assembly which enables the use of a high-powered firearm cartridge of unique profile especially adaptable for use in a short-action firearm. More particularly, the cartridge overcomes the limitations on powder capacity and performance which have previously characterized all short-action cartridges due to their limited length.

In an article which I published in the January, 1996 issue of *Shooting Times* magazine, I discussed the advantages of certain cartridges previously developed by Ackley, Mashburn, Palmisano and Pindell for improved velocity and accuracy. I also mentioned in the article that I had developed a high-power cartridge, adapted for a 0.30 caliber bullet, which had a unique, short, fat profile and which could, for the first time, compatibly combine high velocity, accuracy and power with the compact, well-balanced and lightweight characteristics of a short-action firearm.

However, I had not at that time considered the problems of smooth and reliable feeding and chambering of such a short, fat, bottleneck-shaped cartridge, with its sharply-necked shoulder interconnecting two cylindrical portions of greatly differing diameter. What was needed was a modification to both the cartridge and the bolt assembly of the firearm to ensure smooth and consistent feeding of the cartridges from the magazine.

BRIEF SUMMARY OF THE INVENTION

The present invention was developed to satisfy the foregoing need by providing a unique cartridge configuration and a unique chamber and bolt assembly configuration, both of which enable the use of a short, fat, bottleneck cartridge in a short-action firearm while assuring smooth and reliable feeding and chambering of the cartridges from a magazine.

According to one aspect of the invention, a firearm cartridge is provided having an elongate tubular case capable of withstanding internal gas pressures of at least about 50,000 psi, and having two portions of substantially cylindrical shape and different diameters interconnected by a frusto-conical shoulder portion. The case has a ratio of its overall length to its outer diameter, at a location 1.25 inch from its base, of no more than about 4.2. The base has a rim with an outer diameter substantially no less than the case outer diameter at the aforementioned location.

According to another aspect of the invention, a corresponding chamber and bolt assembly comprises a mating chamber, capable of withstanding internal gas pressures of at least about 65,000 psi, and a bolt having an extractor adjacent to the bolt face which is grippingly engageable with the cartridge by movement of the cartridge transversely to the bolt face when the bolt is in its unlocked position, so as to grip the cartridge while the bolt pushes the cartridge into the chamber.

The wide rim at the base of the cartridge ensures that the base will consistently and reliably be engaged by the bolt face to push it forward out of the magazine, despite the unusual profile of the cartridge. The provision of an extractor configuration, on the other hand, which can grippingly engage the cartridge by movement of the cartridge transversely to the bolt face while the bolt is still in its unlocked position, enables the cartridge to be firmly gripped by the bolt as it pushes the cartridge toward the chamber, eliminating any loose, uncontrolled forward movement of the unusually-shaped cartridge which could cause a malfunction. Although similar wide rim and extractor configurations have existed in the past, they have not previously been used in combination with cartridges or firearm chambers having the uniquely proportioned, short, fat profile of the present invention, for which they provide special feeding and chambering advantages.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 4 is a partially cutaway detail view of the portion of FIG. 3 indicated by the area 4.

FIG. 6 is an enlarged front view of the bolt face, with the rim of the top cartridge shown in dotted lines in two positions, the lower position corresponding to the rim's position in FIG. 5 and the upper position corresponding to its position in FIG. 5A.

FIG. 7 is a sectional bottom view taken along line 7—7 of FIG. 6.

FIG. 8 is a side view of an exemplary embodiment of a cartridge in accordance with the present invention.

DETAILED DESCRIPTION OF THE PREFERRED EMBODIMENT

Figure 1:
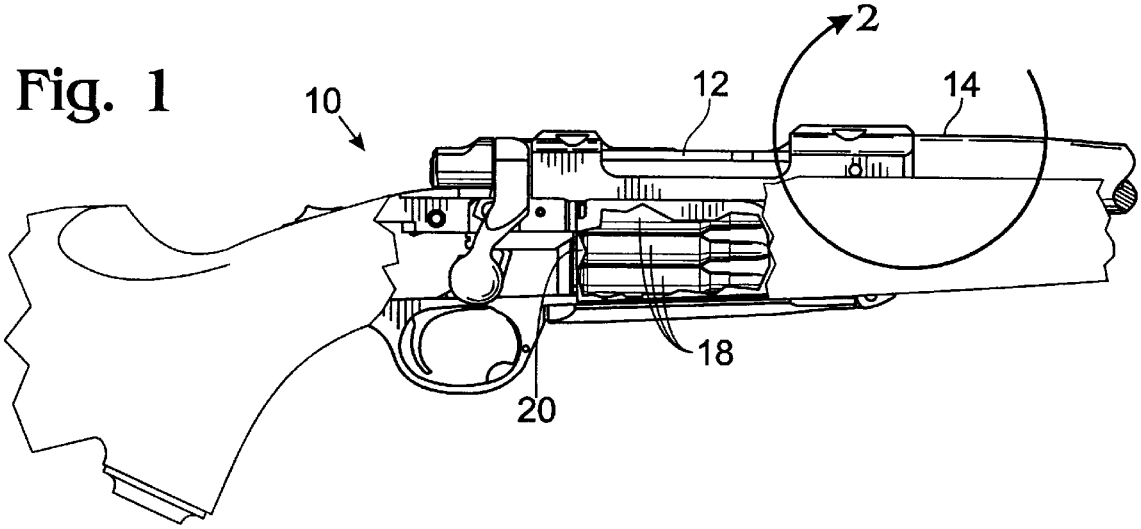
FIG. 1 is a partial side view of a rifle having a short bolt action and modified to incorporate the improvements of the present invention.

FIG. 1 depicts a short-action rifle modified in accordance with the present invention to be capable of employing short cartridges having higher powder capacity, and thus higher performance, than has previously been possible because of the limitations which such short-action firearms place on cartridge length. By way of background, such limitations on cartridge length are due to the firearm's relatively short range of bolt motion between the bolt's fully retracted position and its fully extended, locked position. Such short-action firearms, although having reduced bullet velocity and power, nevertheless have the advantages of lower weight, more compactness, quicker feeding and better balance than do their longer action counterparts. However, when modified in accordance with the present invention, such short-action firearms can attain significantly higher performance comparable to that of their longer action counterparts. In fact, it has been discovered that short cartridges in accordance with the present invention can surprisingly even surpass the performance of long cartridges of the same powder capacity, possibly due to more efficient ignition of the powder in the short case.

It is to be understood that the scope of the present invention is not limited to rifles and their cartridges, but encompasses pistols and other types of firearms as well. Also, although the exemplary embodiment of the invention employs a staggered-column magazine, it could alternatively employ a single-column magazine.

The exemplary rifle 10, as modified in accordance with the present invention, includes a modified bolt assembly 12 and a barrel 14 modified to have a chamber 16 for matingly accepting a modified cartridge 18 in accordance with the present invention. Normally, existing conventional short-action staggered-column magazines such as 20 can be used compatibly with the present invention without modification.

Each cartridge 18 includes a cartridge case 18*a* and a bullet 18*b*. The caliber of the particular bullet 18*b* utilized in the cartridge is a matter of choice. For example, nominal bullet diameters of 0.224, 0.243, 0.257, 0.264, 0.277, 0.284, 0.308, 0.338, 0.358, 0.375, 0.416, and 0.458 are all practical for use in the high performance short cartridge of the present invention. For all calibers of bullet, the important characteristic is the proper proportioning of the cartridge case 18*a* to provide a short cartridge with a high performance.

With reference to FIG. 8, an exemplary cartridge 18 has an elongate tubular case 18*a* capable of withstanding internal gas pressures of at least about 50,000 psi. The case has a first end defining a substantially circular base 22 with an annular rim 24 protruding from a rim groove 25, and a second end defining a mouth 26 for insertably receiving the bullet 18*b*. A first substantially cylindrical case portion 28, and a second narrower substantially cylindrical case portion 30, are interconnected by a frusto-conical shoulder portion 32 extending at an angle of approximately 35° with respect to the axis of the cartridge. At least the wider case portion 28 is preferably not perfectly cylindrical, but rather is slightly frusto-conical, narrowing slightly in a direction away from the base 22. The overall length of the cartridge case 18, designated as L in FIG. 8, extends between the base 22 at the first end and the mouth 26 at the second end of the case. For purposes of the present invention, the outer diameter D of the wider portion 28 of the case 18*a* is measured at a location 34 which is 1.25 inch from the base 22, so as to identify such outer diameter precisely despite the slightly frusto-conical shape of the portion 28. In accordance with the present invention, in order to maximize the powder-carrying capacity of the case 18*a* in a manner which nevertheless produces a cartridge short enough to be used in a short-action firearm, the ratio of the overall case length L over such diameter D (i.e. L/D) should be no more than about 4.2. Preferably, case capacity (without the bullet) should be at least 50 grains of water when filled to its mouth.

By way of example, for higher caliber cartridges the length L could be about 2.2 inches and the diameter D could be between about 0.54 and 0.53 inch. In such case, the length of the portion 28 of the case as measured from the base 22 to the beginning of the frusto-conical portion 32, could be about 1.757 to 1.765 inch, or at least about 75% of the overall case length L. However increases in caliber would generally shorten the frusto-conical portion 32 and increase both the length and the diameter of the narrower cylindrical portion 30 to accommodate the insertion of larger caliber bullets into the mouth 26 of the case.

Figure 2:
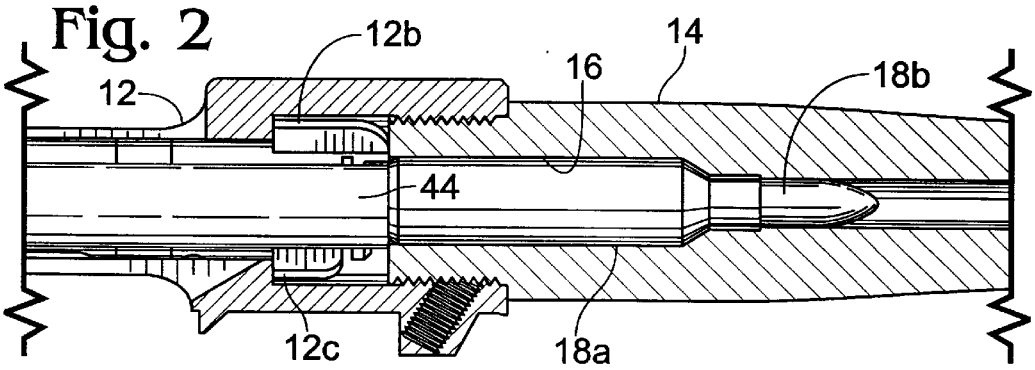
FIG. 2 is an enlarged sectional view of the chamber portion of the rifle of FIG. 1, indicated by the area 2 of FIG. 1, showing a cartridge fully locked within the chamber by the bolt.
Figure 2A:
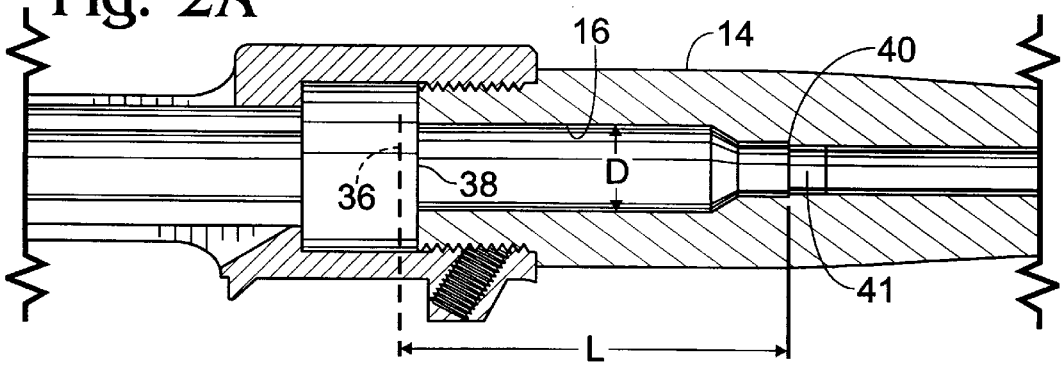
FIG. 2A is a view similar to that of FIG. 2, with the cartridge and bolt withdrawn.
Figure 3:
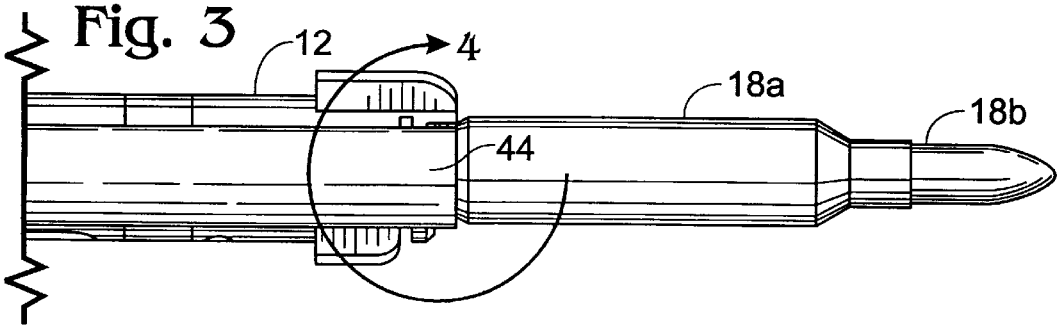
FIG. 3 is an enlarged side view of the locked bolt and cartridge of FIG. 2.

With reference to FIG. 2A, the modified barrel 14 has a chamber 16, capable of withstanding internal gas pressures of at least about 65,000 psi, with substantially mating proportions to those of the cartridge and with about 0.002–0.003 inch larger diametric dimensions to matingly receive the cartridge. For the chamber 16, the length dimension L is measured from the locked bolt face position 36 as shown in FIG. 2A (which corresponds to the position of the base 22 of the cartridge 18 when the bolt assembly 12 is locked). The chamber 16 has a first end 38 which may either be offset from the locked bolt face position 36 as shown, or coincident therewith depending upon the design of the firearm. A second end 40 of the chamber 16 defines a case mouth recess for the cartridge case. Preferably a short throat area 41 of slightly forwardly-tapered frusto-conical shape (for example with a cone angle of approximately 1½° for smaller calibers and approximately 2½° for larger calibers) extends forwardly of the second end 40 of the chamber 16 to provide a smooth bullet-engraving transition.

Figure 5:
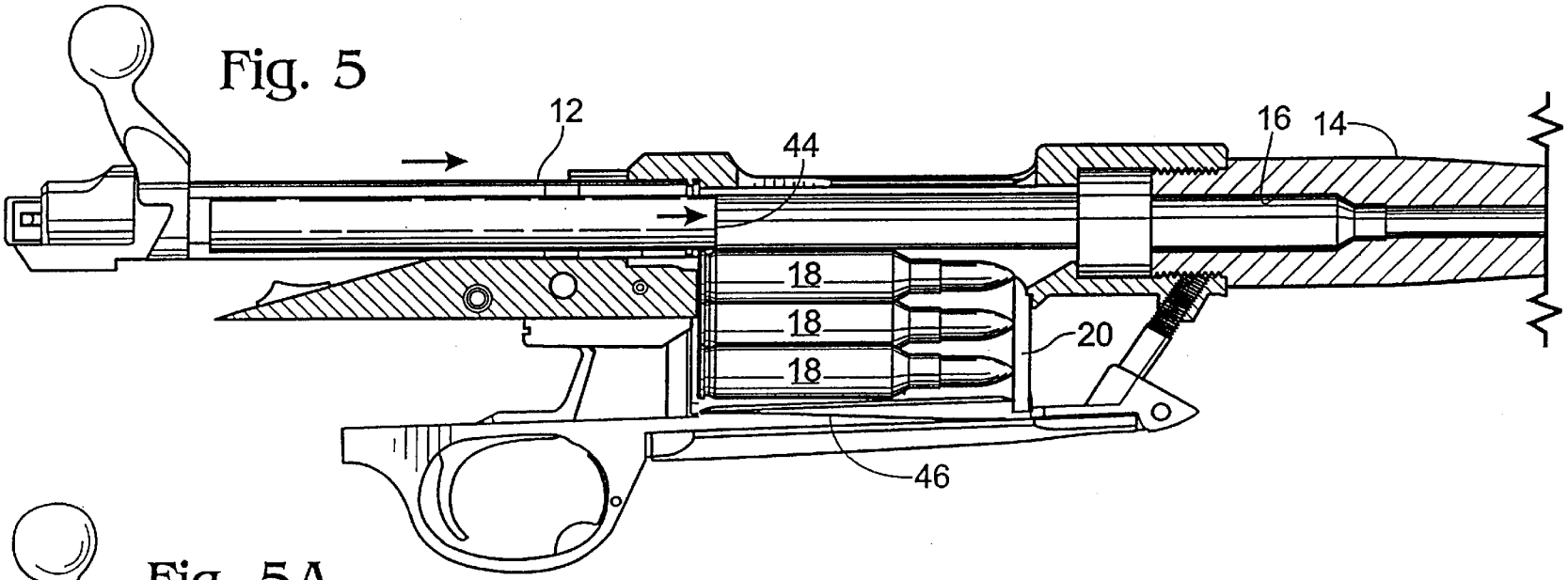
FIG. 5 is an enlarged side sectional view of the bolt, chamber and magazine assembly of the rifle of FIG. 1, with the bolt shown commencing its forward motion to feed the top cartridge.

Ensuring smooth feeding and chambering of the short, fat, sharply-shouldered cartridges of the present invention is accomplished in two different ways. First, the outer diameter of the rim 24 at the base of the cartridge 18 is substantially no less than the outer case diameter D measured at the location 34 (FIG. 8). Such a wide, or unrebated, base rim 24 maximizes the rearwardly-facing surface of the cartridge 18 which is initially engageable by the bolt face 12*a* of the bolt assembly 12 to push the top cartridge forward as the bolt begins its forward feeding movement from its fully retracted position, as shown in FIG. 5. FIG. 6 shows this same initial engagement position of the bolt face 12*a* with respect to the position 24' of the rim 24 of the top cartridge 18, while the cartridge is still retained within the magazine 20. FIG. 6 also illustrates the importance of maximizing the outer diameter of the rim 24 to create a sufficient vertical overlap area 43 with the bolt face 12*a* in light of the top cartridge's relatively low position of retention, due to its profile, in the magazine 20 prior to being engaged by the bolt face 12*a*. Such vertical overlap area 43 is needed so that the bolt face 12*a* can reliably engage the base of the top cartridge 18 to push it forward and out of retention by the magazine 20.

Figure 5A:
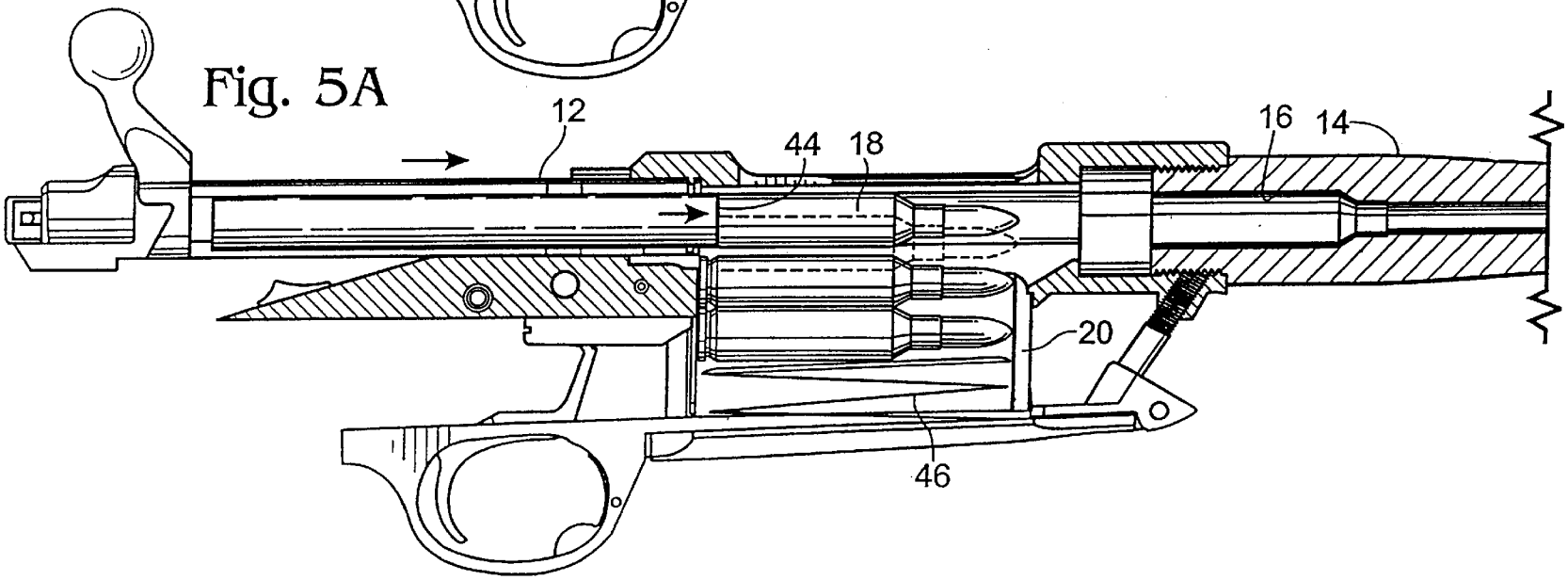
FIG. 5A is a view similar to that of FIG. 5, with the bolt advanced further forwardly to a position where the magazine spring has pushed the cartridges upwardly so that the rim of the top cartridge has moved transversely to the bolt face to a position where it is gripped between the extractor and the bolt face.

The second feature of the present invention which ensures smooth feeding and chambering of the cartridges, despite their unusual profiles, is a modification of the bolt face 12*a* relative to the extractor 44. As the bolt assembly 12 slides forward from its position shown in FIG. 5, the top cartridge 18 is released by the magazine so that the magazine spring 46 can push it upwardly through an intermediate position shown in dotted lines in FIG. 5A to the fully elevated position shown in FIG. 5A. In making this transition, the rim 24 of the top cartridge moves upwardly, transversely to the bolt face 12*a*, from the position 24' to the position 24" shown in dotted lines in FIG. 6. The bolt face 12*a* is modified to provide an open-bottomed channel 48 (FIG. 7) between the bolt face 12*a* and lip 44*a* of the extractor 44, wide enough to accept the rim 24 so that the extractor grips the rim 24 between the extractor lip 44*a* and the bolt face 12*a* as shown in FIG. 6 as the cartridge moves upwardly. This enables the extractor 44 to grip the cartridge firmly in its proper alignment for chambering, as shown in FIG. 5A, before the cartridge begins to enter the chamber 16 so that the unique profile of the cartridge has no opportunity to interfere with its smooth entry into the chamber. After chambering, the bolt assembly is rotated in the normal manner so that the locking lugs 12*b* and 12*c* are oriented vertically, as shown in FIG. 2, to lock the bolt face 12*a* in its locked position 36.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A firearm chamber and bolt assembly comprising a tubular chamber for matingly receiving a tubular cartridge case, and an elongate bolt, having a bolt face, selectively slidable longitudinally in a sliding direction between a retracted unlocked position and an extended locked position for pushing said cartridge case into said chamber and providing a locked bolt face when said bolt is in said locked position, said chamber being capable of withstanding internal gas pressures of at least about 65,000 psi and having a first end, adjacent to said locked bolt face, for insertably receiving said cartridge case and a second end defining a case mouth recess for said cartridge case, said chamber having a first portion of a substantially cylindrical shape adjacent to said first end and a second portion of a narrower substantially cylindrical shape adjacent to said second end, and a frusto-conical portion interconnecting said first portion and said second portion, said chamber defining an overall length measured from said locked bolt face to said second end of said chamber, said first portion having an inner chamber diameter at a location 1.25 inch from said locked bolt face of at least about 0.53 inch, said overall length having a ratio to said inner chamber diameter at said location of no more than about 4.2, said bolt having an extractor adjacent to said bolt face and a channel oriented transversely to said sliding direction of said bolt through which a rim portion of said cartridge, having an outside diameter substantially no less than said inner chamber diameter at said location, is movable transversely to said sliding direction into gripping engagement by said extractor before said cartridge is inserted into said chamber.

2. The firearm chamber and bolt assembly of claim 1 wherein said first portion of said chamber has a first portion length extending between said locked bolt face and said frusto-conical portion, said first portion length having a ratio to said inner chamber diameter at said location of no more than about 3.33.

* * * * *